US005402101A

United States Patent [19]

Berger et al.

[11] Patent Number: 5,402,101

[45] Date of Patent: Mar. 28, 1995

[54] METHOD FOR DETERMINING THE CONFIGURATION OF DETECTORS OF A DANGER ALARM SYSTEM AND FOR DETERMINING THE SYSTEM CONFIGURATION OF SUITABLE DETECTORS

[75] Inventors: Horst Berger, Kaarst; Heiner Politze, Neuss; Peter Ungemach, Dormagen, all of Germany

[73] Assignee: Esser Sicherheitstechnik GmbH, Neuss, Germany

[21] Appl. No.: 909,572

[22] Filed: Jul. 6, 1992

[51] Int. Cl.[6] ..... G08B 29/00

[52] U.S. Cl. ..... 340/286.02; 340/825.5; 340/505; 340/508; 340/509; 340/512

[58] Field of Search ..... 340/286.02, 825.22, 340/825.5, 825.51, 825.52, 505, 508, 509, 512

[56] References Cited

U.S. PATENT DOCUMENTS

| | | | |
|---|---|---|---|
| 4,360,912 | 11/1982 | Metz et al. | 340/825.54 |
| 4,885,568 | 12/1989 | Hackett | 340/825.08 |
| 4,947,162 | 8/1990 | Kimura | 340/825.52 |

*Primary Examiner*—Donnie L. Crosland
*Attorney, Agent, or Firm*—Henry M. Feiereisen

[57] ABSTRACT

A danger alarm system includes a plurality of detectors, each of which having a microprocessor, a current drain controllable by the microprocessor for data exchange with a central station, an address register, and a nonvolatile memory for containing an individual binary serial number. In order to allow with few exceptions the use of relayless detectors, the configuration of the detectors is determined by providing each detector with a unique binary serial number at the manufacturer's end, identifying and storing in an initialization routine the serial numbers, setting all detectors through a collective command in a discrete addressing mode and response mode for allowing each detector after being addressed by its own binary serial number to respond with a current pulse and subsequently after being addressed with the binary serial number of another detector to check the occurrence or absence of a current pulse and to store the test result as binary pattern, polling the stored binary pattern from each detector and forming from this pattern and from the binary serial numbers of the respective detectors a first matrix and a second matrix which is defined by the column sums and line sums of the first matrix, and by evaluating the first and second matrices in accordance with a given algorithm for determining the system configuration.

13 Claims, 4 Drawing Sheets

FIG. 4

| No. \ No | 87 | 81 | 46 | 44 | 41 | 40 | 39 | 22 | 21 | 20 | 11 | ΣH |
|---|---|---|---|---|---|---|---|---|---|---|---|---|
| 87 | 0 | 0 | 0 | 0 | 0 | 0 | 1 | 1 | 1 | 0 | 1 | 4 |
| 81 | 0 | 0 | 0 | 0 | 0 | 0 | 1 | 1 | 1 | 0 | 1 | 4 |
| 46 | 0 | 0 | 0 | 0 | 0 | 0 | 0 | 1 | 0 | 0 | 1 | 2 |
| 44 | 0 | 0 | 1 | 0 | 0 | 1 | 0 | 1 | 0 | 0 | 1 | 4 |
| 41 | 0 | 1 | 0 | 0 | 0 | 0 | 1 | 1 | 1 | 0 | 1 | 5 |
| 40 | 0 | 0 | 1 | 0 | 0 | 0 | 0 | 1 | 0 | 0 | 1 | 3 |
| 39 | 0 | 0 | 0 | 0 | 0 | 0 | 0 | 1 | 1 | 0 | 1 | 3 |
| 22 | 0 | 0 | 0 | 0 | 0 | 0 | 0 | 0 | 0 | 0 | 1 | 1 |
| 21 | 0 | 0 | 0 | 0 | 0 | 0 | 0 | 1 | 0 | 0 | 1 | 2 |
| 20 | 0 | 1 | 0 | 0 | 1 | 0 | 1 | 1 | 1 | 0 | 1 | 6 |
| 11 | 0 | 0 | 0 | 0 | 0 | 0 | 0 | 0 | 0 | 0 | 0 | 0 |
| $\Sigma V_i$ | 0 | 2 | 2 | 0 | 1 | 1 | 4 | 9 | 5 | 0 | 10 | |

METHOD FOR DETERMINING THE CONFIGURATION OF DETECTORS OF A DANGER ALARM SYSTEM AND FOR DETERMINING THE SYSTEM CONFIGURATION OF SUITABLE DETECTORS

BACKGROUND OF THE INVENTION

The present invention refers to a method for determining the configuration of detectors of a danger alarm system of the type having a central station which is parallel connected to the detectors via a two-wire communication line in form of a loop and/or stubs, with each detector including i.e. a microprocessor by which a current drain is controlled for data exchange with the central station by means of current pulses and an address register.

European publication EP-A1-0 191 239 discloses a danger alarm system with detectors which are parallel connected in a two-wire communication line and include particular structural features by which the central station is able to recognize the installation sequence of the detectors. The recognition is carried out regardless as to whether the communication line is a stub, a loop or a combination of both. Each detector has at least one relay, with the communication line running across the contacts of the relay. Further, each detector includes an address register and a microprocessor which allows a data exchange with the central station. During initial breaking in of the danger alarm system, the so-called initialization routine, the relay contacts are open in all detectors. The central station assigns to the first, i.e. the nearest detector, an address and transmits to this detector the command to store this address and to activate its relay for closing its contacts. In a like manner, the central station communicates with the second detector and the following detectors. After terminating the initialization routine, the central station has individually recognized all detectors and is able to communicate with them via their address if the communication line is a simple stub or loop. In the event, the installation includes several, possibly further branched stubs and/or subloops, special detectors are installed at the branch-off points or junction points, with the special detectors containing a second relay which operates with the first relay as a so called T-switch. In this case, the initialization routine is initially done in direction towards the branch ends (stub or subloop) until reaching the pertaining last detector. The central station then continues from the branch-off point in the other branch-off direction after transmitting to the respective detector the command for switching over its T-switch. Through recognition of the sequence of the detectors and the position of the particular, T-switch containing detectors, the topology of the system, i.e. the precise configuration of its detectors can be determined.

A danger alarm system of this type has a drawback that in order to attain a desired small power consumption, this system requires the equipment of each detector with an expensive bistable relay. This drawback is compounded by the fact that those special detectors which are located at the branch-off points require two such relays. Substitution of such relays through semiconductor circuits is not possible because the serial connection results in increasing voltage drops and apart from that, would also not result in a more cost-effective system.

In this conventional system, the address assigned to a detector designates also the location of installation of the detector so that an exchange of two or more detectors which is not recognized by the central station would result in a misdirection of e.g. intervening forces because alarm signals triggered by these detectors would be interpreted as being originating from the respective original location of installation. In order to prevent such errors, the known system stores the detector address in a volatile memory which means that this information is lost when removing the detector. Moreover, the removal of more than one detector is indicated in the central station as malfunction so that a correction of the malfunction has to be followed by a new initialization. Even though the described problem could be eliminated in a system in which the address register of each detector is located in its generally fixedly secured pedestal; the necessity of a second printed circuit in each detector pedestal as well as respective junction contacts to the detectors would result in prohibitively high costs and less reliable operation so that such a solution is not feasible.

SUMMARY OF THE INVENTION

It is an object of the present invention to provide an improved method of the above type obviating the aforestated drawbacks.

In particular, it is an object of the present invention to provide an improved danger alarm system which utilizes simple mostly relayless detectors which usually require a new initialization routine during modification of the configuration (changes of the existing installation) only in correspondence with proposed modifications.

These objects, and others, which will become apparent hereinafter, are attained in accordance with the present invention by assigning to each detector a binary serial number and by having the central station run the following steps after installation of the system:

1. identifying and storing in an initialization routine the serial numbers;
2. setting all detectors through a collective command into a discrete addressing mode and response mode for allowing each detector after being addressed by its own binary serial number to respond with a current pulse and subsequently after being addressed with the binary serial number of another detector to check the occurrence or absence of a current pulse and to store the test result as binary pattern;
3. individually addressing in a first cycle each detector by its binary serial number;
4. polling in a second cycle the stored binary pattern from each detector and recording the address corresponding to the binary serial number of each detector in a column of a first square matrix having columns and lines which are numbered correspondingly with the binary serial numbers in the system;
5. determining the sum of each column and the sum of each line of the first matrix and transferring the sum of each column and the sum of each line in numbered lines of a second matrix, with the numbered lines running correspondingly with the lines of the first matrix;
6. determining the number of stubs on the basis of the values of the column sums of the first matrix and identifying the detector arranged last in each stub;

7. identifying the detectors of the first stub on the basis of the line sums of the second matrix and determining the sequential arrangement of the detectors in the first stub;
8. identifying the detectors preceding each of the last detectors and combining them to a group of detectors;
9. determining for each group from the groups of preceding detectors, through formation of intersections, those detectors which belong only to this group;
10. upon presence of a loop, feeding in the other loop end and identifying analogous to step 7) the detectors of the first stub for determining the group of detectors forming the loop;
11. upon presence of stubs, comparing the values of the column sums of the first matrix for determining the location of the branch-off points of the stubs and the sequence of the detectors thereof; and
12. assigning installation numbers to the detectors in correspondence to the identified configuration and outputting the detector configuration of the system including the installation numbers.

According to a further feature of the invention, a danger alarm system in accordance with the present invention includes detectors which contain a nonvolatile memory for an individual binary serial number.

In accordance with the present invention, a danger alarm system can now be installed with a random number of detectors in a communication line containing stubs, loops or a combination thereof, without essentially requiring specially designed and expensive detectors, and yet allows a precise monitoring and recognition of occurring alarms. Moreover, complete and time consuming renewed initializing routines are usually not required when modifying the configuration.

BRIEF DESCRIPTION OF THE DRAWING

The above and other objects, features and advantages of the present invention will now be described in more detail with reference to the accompanying drawing in which:

FIG. 4 is a simplified example of a S-matrix required for recognizing the configuration of a danger alarm system.

DETAILED DESCRIPTION OF A PREFERRED EMBODIMENT

Figure 1:
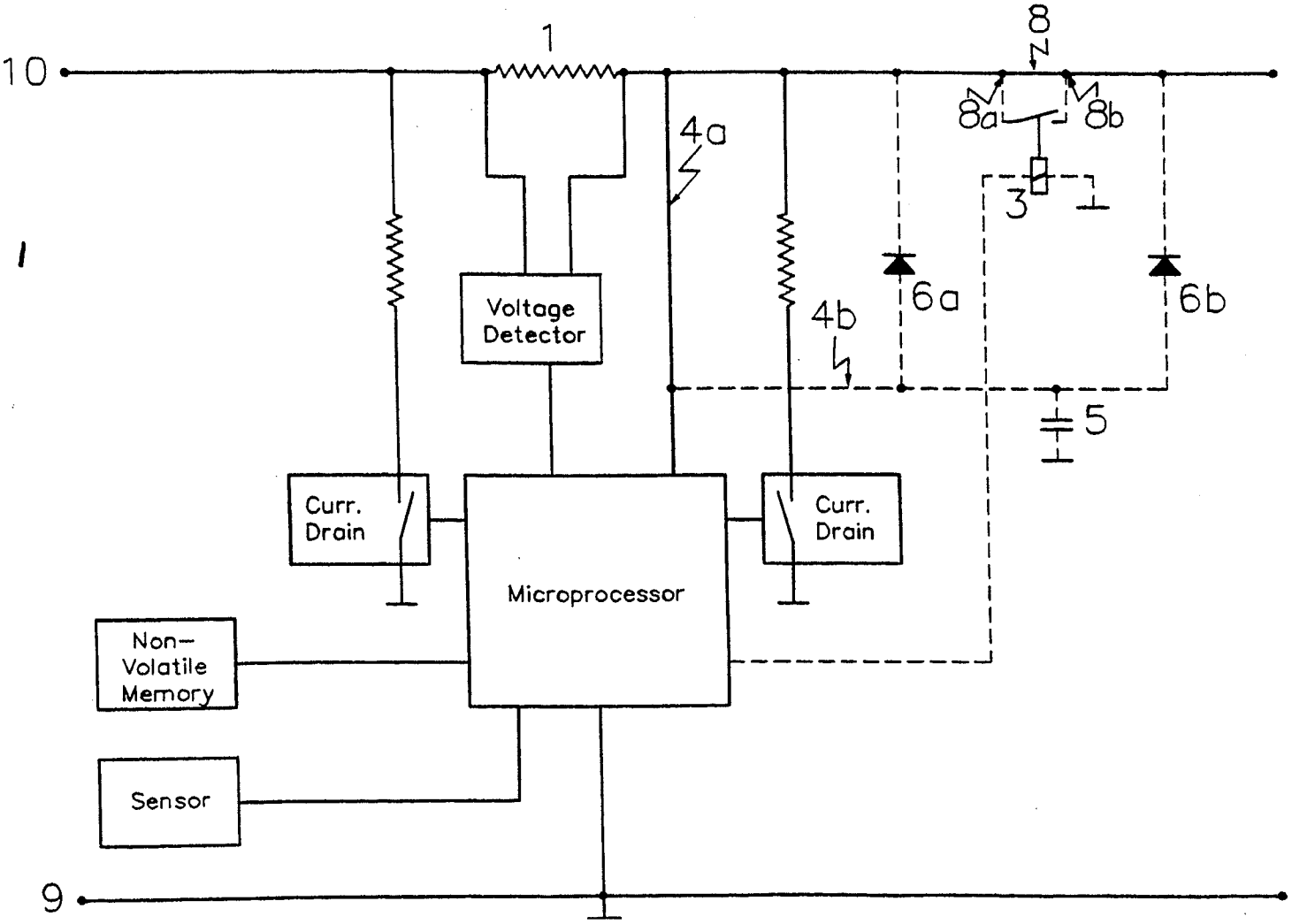
FIG. 1 is a schematic block diagram of a detector of a danger alarm system in accordance with the present invention.

Turning now to FIG. 1, there is shown a schematic block diagram of a detector which includes a microprocessor 4 with a sensor 7, a nonvolatile memory 15, e.g. in form of a programmable read only memory (PROM), an ammeter unit and a current drain 13*a*, 13*b* before and behind the ammeter unit. The ammeter includes a series resistor 1 which is arranged in the one wire of a two-wire communication line between the detector terminals 10, 12. The other wire represents the reference potential, usually mass, and is connected with the detector terminals 9, 11. The voltage drop across the series resistor 1 is measured by a voltage detector 2 which is connected to the microprocessor 4. Also connected to the microprocessor 4 is the sensor 7 and the nonvolatile memory 15. The microprocessor 4 controls the first current drain 13*a* and the second current drain 13*b*. Supply of voltage is fed to the microprocessor 4 via a line 4*a* which branches off the one wire of the communication line containing the terminals 10, 12. The microprocessor 4 further includes a conventional shift register which is not shown in detail.

Persons skilled in the art will appreciate that it would be sufficient to provide the detector with only one single current drain e.g. 13*a*. By means of the current drain 13*a*, the microprocessor 4 generates a current pulse sequence which contains in coded form the message to be sent to the central station. Utilization of the second current drain 13*b* allows the following additional functions:

By means of the ammeter unit 1, 2, the microprocessor 4 can recognize the feed direction.

The microprocessor 4 is able to verify the function of the ammeter unit 1, 2 as well as its own function regardless of the feed direction.

The second current drain generates the current pulse sequence to be transferred to the central station when the current path of the first current drain 13*a* is connected for signaling an alarm via e.g. a red light emitting diode, with the illumination of the light emitting diode being prevented at normal communication of the detector with the central station.

On the other hand, the current path of the second current drain may be connected via a second light emitting diode, possibly emitting light of different color, e.g. for diagnostic purposes.

By means of the two current drains 13*a* and 13*b*, different current values can be generated e.g. in case of communication or in case of alarm.

For safety reasons, present regulations require a danger alarm system to be equipped with a separating element after maximal 32 detectors to avoid that a short circuit or a detector malfunction results in a total breakdown of the overall system. Detectors equipped with separating elements e.g. in form of a relay contact in the life wire of the communication line are known per se. A separating element for supplementing a detector as described above is shown e.g. in FIG. 1 in broken lines. In this case, the microprocessor 4 controls a relay 3 which has a contact substituting the wire section 8 between the terminals 8*a* and 8*b* which in a detector without relay is e.g. a shorting bar. When providing the detector with a relay 3, the supply line 4*a* for the microprocessor 4 is omitted. In this case, the microprocessor 4 receives its supply voltage via the line 4*d* as well as one of the diodes 6*a* or 6*b* depending on whether the detector is supplied from the central station via the terminal 10 or via the terminal 12, with the respective other diode serving for uncoupling. Connected to line 4*b* against the reference potential is a capacitor 5 which supplies the microprocessor 4 with operational voltage at a power outage (e.g. due to a short circuit) for as long as is required to allow the microprocessor 4 to activate the relay 3 and thus to keep its contact open. The relay 3 and/or its contact may also be incorporated within the pedestal of the detector.

The arrangement of detectors and a separating element which is represented by the relay 3 and its contact, including the next one may be designated as "segment".

After having described the individual parts of a detector, the mode of operation for recognizing the configuration of a danger alarm system which is provided with a random number of detectors according to FIG. 1 is set forth with reference to FIGS. 2–4.

Figure 2:
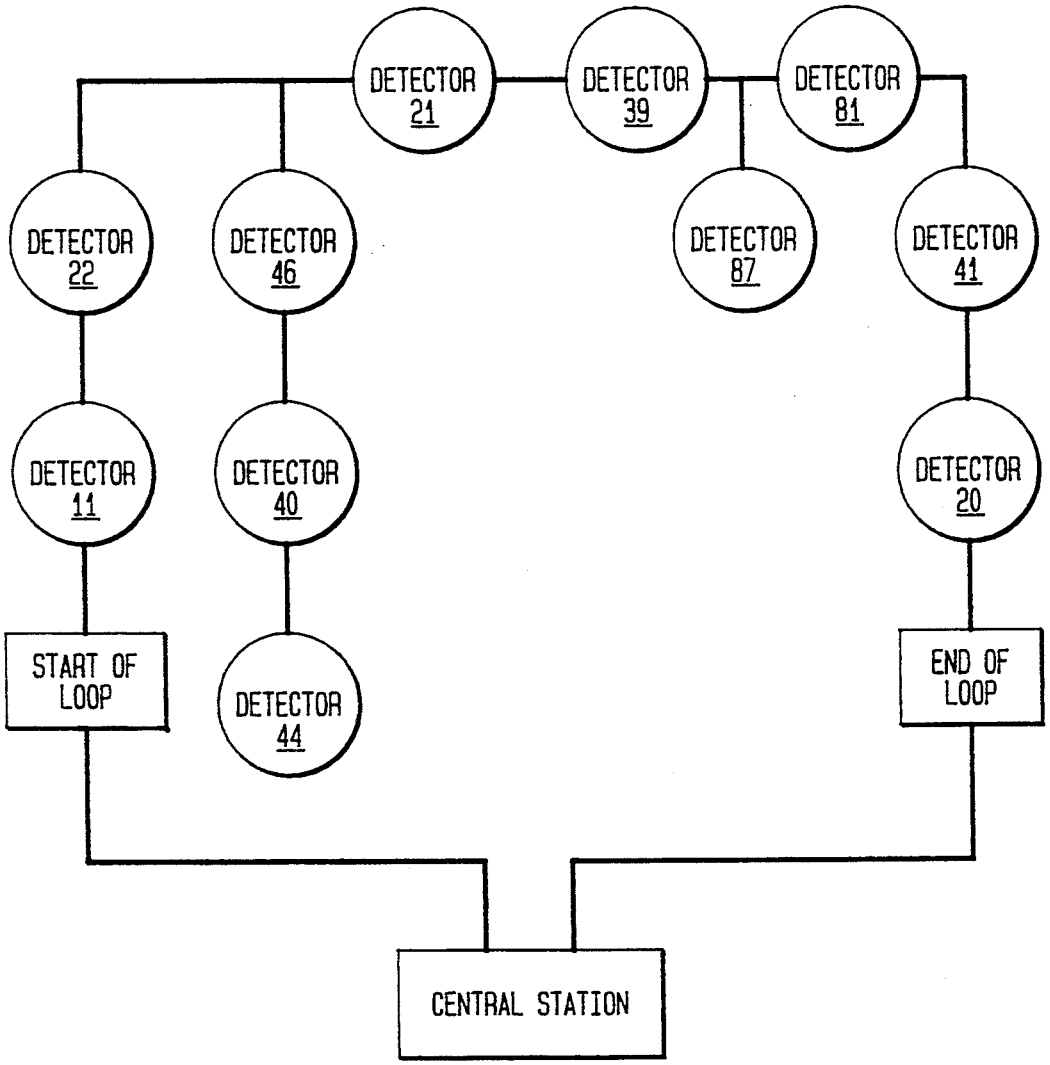
FIG. 2 is a greatly simplified schematic block diagram of an exemplified configuration of a danger alarm system.
Figure 3:
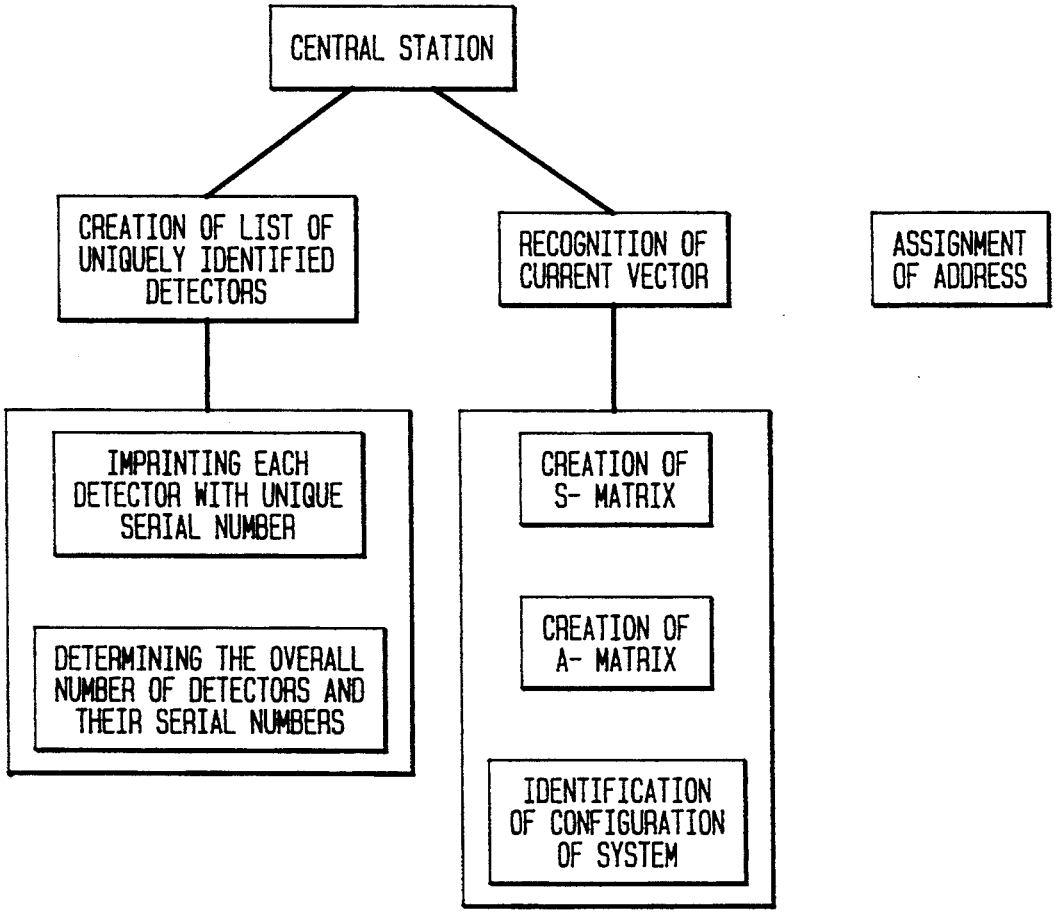
FIG. 3 is a schematic block diagram generally illustrating the process steps for determining the configuration of the danger alarm system.

Turning to FIG. 2, there is shown a greatly simplified schematic block diagram of an exemplified configuration of a danger alarm system, including a central station Z which may either feed into the beginning A or into the end B of a loop. Successively arranged in the loop are detectors 11, 22, 21, 39, 81, 41 and 20. A first stub with three detectors 46, 40 and 44 branches off between the detectors 22 and 21. A second stub containing only one single detector 87 branches off between the detectors 39 and 81.

Upon complete installation of the system, the detectors are arranged quasi parallel (not a pure parallel circuit because of the series resistor 1 of the ammeter unit in each detector) in the communication line, which contains a random arrangement of stubs and/or loops. The detectors are randomly distributed, with the central station in an initial stage being unable to differentiate between the detectors and initially unable to recognize the number of installed detectors.

In order to recognize the configuration of the system, the following three steps are necessary (see also FIG. 3):

A. Creation of List of Uniquely Identified Detectors

The objective of this step is to allow the central station to individually address each detector as well as to determine the overall number of detectors.

B. Recognition of a so-called Current Vector

The objective of this step is the determination of the configuration of the detectors and thus of the overall system.

C. Assignment of an Address

The objective of this step is the assignment and storage of discrete addresses in the detectors and within the central station.

In the following, the individual steps are described in detail:

A. Creation of List of Uniquely Identified Detectors

During manufacture, each detector is provided with a distinct serial number which is imprinted upon the housing of the detector and stored as binary number in a nonvolatile memory in the detector. Each detector is thus unique and one of a kind which differs by its housing imprint as well as by its stored binary number from every other detector.

The central station sets all detectors through a collective command in an initialization routine. In this stage, each detector transmits a current response to the central station when recognizing its serial number in a data telegram as sent by the central station. Therefore, through polling of all possible serial numbers, the central station is able to determine the actual number of installed detectors and their serial numbers. Assuming that the serial number has a length of e.g. 24 bits, i.e. 24 cells, the described procedure becomes very time consuming. For that reason, the use of a different known algorithm by which the procedure can be carried out more rapidly is recommended.

For example, the method of successive approximation may be applied. In this case, the central station sends initially to all detectors the collective demand "new initialization". The microprocessor of each detector is set to a mode in accordance with this algorithm. The central station now sets in an internal storage area, which has a width corresponding to the number of digits of the serial number, the most significant bit (MSB) to "1" and sends to all detectors the collective inquiry:

"Are detectors present which have a "1" as most significant bit?"

Subsequently all detectors for which this is true (i.e. which have as MSB a "1") send a current response to the central station. This may be the case for no detector or for one or several detectors. The central station determines whether at least one detector responds affirmatively to the interrogation (there is no determination as to the number of responding detectors).

If this is the case, the next lower order bit is additionally set to "1" and the following collective inquiry is sent:

"Are detectors present with both most significant bits equalling "1"?

If none of the detectors responds affirmatively to the question for "1" in the MSB, the central station changes the MSB to "0". The next lower order bit remains at "1". Thereafter the central station sends the collective inquiry:

"Are detectors present which have in both most significant bits the bit sequence "01"?"

This process is now carried out until all bits of the serial number are polled and eventually the highest serial number in the communication line i.e. in the overall installation, respectively, has been found. The bit sequence recorded in the central station in view of the current responses then designates the detector with this highest serial number.

This procedure corresponds logically to a halving of the possible value areas and a threshold inquiry to those detectors in which half the respective serial number lies. When determining the respective half, the latter is again halved (corresponds to the setting of the next lower order bit) etc. The number of interrogating steps corresponds exactly to the number of bits of the serial number i.e. a 24-digit serial number requires exactly 24 steps in order to recognize the particular, given serial number.

As soon as the serial number of a detector is determined in this manner, the central station sends the command to this detector to remain passive until the entire algorithm of recognition is run. Thus, this detector will not respond to interrogations sent from the central station so that the central station can now determine the detector with the next lower serial number.

The described procedure is repeated by the central station until the last serial number resulting from the algorithm is "0" in all bits, thus corresponding to a non-existing serial number of "0".

At this stage, the central station knows:

the number of detectors;

the serial numbers of the detectors;

the type of detectors (e.g. broken glass detectors, heat-sensitive detectors, smoke detectors, etc.) since the serial numbers contain also codes regarding information about the type of detector, which detectors contain a relay for separation of the communication line (separating element). This information may also be contained in coded form in the serial number or may be transmitted as additional information from the microprocessor of the detector to the central station.

The described procedure thus requires the following number of steps for recognizing n-detectors with different serial numbers of e.g. 24 bits:

$$S=24*(n+1)$$

wherein S represents the number of steps and n the number of total detectors provided in the system. "(n+1)" refers to the fact that for recognizing the end of the interrogation, a separate additional step is carried out: "Are there still detectors which do not passively behave?"

In the following, a numerical example for creating a list of uniquely defined detectors in accordance with the described procedure is given. For purposes of illustration, the communication line contains only 3 detectors (as yet not known to the central station). Each detector has a 4 bit wide, distinct serial number.

Serial number of detector 1: 1001
Serial number of detector 2: 1100
Serial number of detector 3: 0010

| Polling Through Central Station | Current Response | |
|---|---|---|
| 1000<br>1100<br>1110<br>1101 | 1<br>1<br>0<br>0 | Detector "A" has address "1100" |
| 1000<br>1100<br>1010<br>1001 | 1<br>0<br>0<br>1 | Detector "B" has address "1001" |
| 1000<br>0100<br>0010<br>0001 | 0<br>0<br>1<br>0 | Detector "C" has address "0010" |
| 1000<br>0100<br>0010<br>0001 | 0<br>0<br>0<br>0 | END |

As previously set forth, the algorithm as described above, represents only one of several possibilities to create the list of uniquely identified detectors in a time saving manner. A simple variation is to start the interrogation with the least significant bit (LSB).

An even more time saving procedure can be achieved by running the algorithm not linearly as described but by evaluating already received responses so as to avoid a rerun of particular inquiries and to shorten the algorithm. For example, in the procedure as described, the number of a detector determined last is the highest serial number at the time. Interrogation of the remaining detectors can thus be shortened by those steps which are necessary for recognizing serial numbers which are equal or higher than the serial number determined last.

In a newly installed system, all existing detectors originate with high probability from a relative narrow manufacturing period and thus differ only in the lower order bits. After recognizing the (probably same) higher order bits, the algorithm can be limited to the lower order bits so as to drastically reduce the number of required steps for recognizing all serial numbers. When using such a shortened algorithm, it must be ensured that possible detectors with greatly deviating serial numbers can also be recognized. In such cases in which detectors with greatly deviating serial numbers are included the "shortened" algorithm may actually be considerably slower than the above described complete algorithm.

B. Recognition of Current Vector

Since each detector can now be addressed by its serial number (for shortening the data traffic, the central station may also substitute each serial number of 24 bits by an internal number with e.g. 7 bits), the detectors are prepared via a collective command to the so-called current vector recognition. By means of its ammeter unit, each detector recognizes those current pulses which originate from detectors, arranged as viewed from the central station, behind the recognizing detector. Upon reception of its own serial number, the detector generates a current pulse for a period at least as long as the other detectors are capable of registering this current pulse. However, the detector which generates the current pulse does not measure its own current pulse.

The central station now polls all serial numbers. With each interrogation, all detectors load the result of their current measurement into the shift register contained in their microprocessor 4 and increment the result. If a current increase is recognized by a detector, its microprocessor records this in its shift register with a logic "1", in the other case with a logic "0". Its own transmitted current pulse is recorded in the shift register by the detector with a logic "0".

Since the sequence of the terminals 10, 12 of each detector at each side of the ammeter unit 1, 2 is exchangeable, also negative current values may be encountered. Before loading the information of the current measurement into the shift register, a value determination is carried out. Upon occurrence of negative current values, this determination is stored in the microprocessor as well.

After each detector has transmitted its current response and has measured the current response of the other detectors, the shift register of each detector includes a bit sequence which subsequently is designated as current vector with the dimension n, wherein n again is the number of existing detectors. Since each detector has registered such a current vector, n current vectors exist which differ from each other. These current vectors are polled by the central station via the individual serial numbers of the existing detectors and recorded in the columns of the matrix. This matrix is subsequently designated as "S-matrix" and is illustrated in FIG. 4 for the system configuration as shown in FIG. 2. The lines of the S-matrix contain the individual current responses. Each line thus shows the current pulse pattern which is recorded in the shift registers of all other detectors at the time of interrogation of the detector corresponding to this line. The provision of the S-matrix allows determination of the system configuration through summation of the lines and columns of the matrix. The corresponding values are designated in FIG. 3 with $\epsilon H$ and $\epsilon V$. The sum $\epsilon H$ of each line i (i from 1 to n) yields information about the number of detectors between the central station and the detector with the $i^{th}$ serial number.

The sum $\epsilon V$ of each column yields the information about the number of detectors between the $i^{th}$ serial number and the end of a stub or the loop. The sum of lines and the sum of columns of the S-matrix together form with the pertaining serial numbers a new matrix, the so called A-matrix which in the selected example has the following configuration:

| ΣH | ΣV | Ser. No. |
|---|---|---|
| 4 | 0 | 87 |
| 4 | 2 | 81 |
| 2 | 2 | 46 |
| 4 | 0 | 44 |
| 5 | 1 | 41 |
| 3 | 1 | 40 |
| 3 | 4 | 39 |
| 1 | 9 | 22 |
| 2 | 5 | 21 |
| 6 | 0 | 20 |
| 0 | 10 | 11 |

The A-matrix provides the following information:

a) The number of stubs; it is equal to the number of zeros in the ϵV (the end of the loop is also counted)

and thus:

b) The serial number of the last detector in each stub or loop. In the present example, these are the detectors 87, 44 and 20. Which position these detectors occupy is not known as of yet.

c) The serial numbers of the detectors as well as their sequence between the central station and the first stub. These informations follow from the column sum ϵH, i.e. those numbers which occur only once and are arranged with increasing sequence up to the first number which exists at least twice in different lines. In the present example, these are the detectors 11 and 22.

Next, the central station determines the still necessary information for determination of the spatial configuration. The A-matrix delivers the number of end detectors and their serial numbers. The current vectors in the S-matrix ("1"-entry in the respective lines) designate the detectors further pertaining to the respective end detector. For the example of FIG. 2, the following three groups are obtained in this manner:

d) Group 1 of end detector 87=>39 22 21 11 e) Group 2 of end detector 44=>46 40 22 11 f) Group 3 of end detector 20=>81 41 39 22 21 11

The central station now forms the intersections of these three groups which can be graphically illustrated as follows:

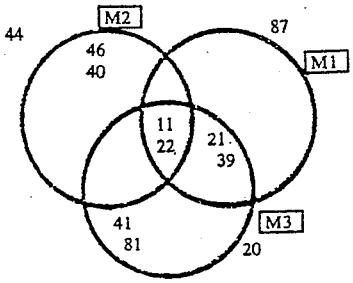

Apart from the already known information according to preceding paragraph c) that detectors 11, 22 are the detectors in the loop (corresponding to M1∩M2∩M3), the following further results can be derived:

The detectors belonging solely to the group 1 (end detector 87) are obtained from: M1/(M2∩M3). The example does not show any further such detectors.

The detectors further belonging solely to group 2 (end detector 44) are obtained from: M2/(M1∩M3). These are the detectors 46 and 40.

The detectors further belonging solely to group 3 (end detector 20) are obtained from: M3/(M2∩M1). These are the detectors 41 and 81.

As such, the loop is not as of yet recognizable so that the result is still ambiguous, i.e. the detectors 21 and 39 may belong either to group 1 or to group 3 (M1∩M3). The central station switches over to supply the communication line from the opposite direction, i.e. it now feeds into the line end B of the communication line. The repetition of the previously described interrogation yields the information that the detector 20 is now first and the detector 11 is last, and moreover the sequence of the detectors arranged in-between within the loop. Thus, the central station recognizes that the detectors 21 and 39 belong to the loop and thus to the group 3 together with the detectors 11 and 22.

In the event, the communication line is not closed in a loop-shaped manner and contains only stubs, the assignment can be carried out by assigning identifying numbers to the stubs in accordance with the number of detectors in each stub, i.e. starting with the stub containing the greatest number of detectors, or by randomly assigning identifying numbers to the stubs. Assuming for example that an exemplified danger alarm system has a central station which is operatively connected to a single communication line which contains seventeen detectors and from which a stub with seven detectors branches off after the sixth detector. Initially, the central station recognizes only the six detectors in the communication line before the branch-off point to the stub and further the presence of two lines, with one line (first stub) containing seven detectors and the continuation of the communication line (second stub) with eleven detectors. The only distinction between the two lines as recognized by the central station are the different number of detectors. The central station now assigns identifying numbers to the stubs, either by starting with the stub containing the greatest number of detectors or by randomly assigning identifying numbers. Random assignment of identifying numbers has the advantage in those cases in which stubs contain the same number of detectors.

Thus, the central station now knows the basic configuration of this system. It recognizes the presence of a loop and, if affirmative, which detectors belong to this loop, and moreover, the number of stubs and which detectors belong to which stub.

By means of the increasing sequence of the values of the line sum ϵH of the A-matrix, the central station determines in a last step the position of the branch-off points and the sequence of the detectors in the respective stubs by proceeding in a manner as previously described under paragraph c), however under consideration of numbers or values occurring more than once.

Thence, the configuration of this system is determined and taking the example of FIG. 2, the following is known:

The loop starts with the detectors 11 and 22, has a branch with detectors 46, 40 and 44 (the latter being the last or end detector), is continued by the detectors 21 and 39, has a further branch which comprises only the detector 87 which thus is simultaneously the end detector, and is closed via the detectors 81, 41 and 20, the latter being interpreted also as end detector.

C. Assignment of an Address

The central station now assigns installation numbers to the detectors in correspondence to the recognized configuration and outputs the recognized configuration together with these installation numbers via a screen and/or printer. The user of the system can now record the installation numbers as selected by the central station into his or her installation plan and can input into the central station informations to all or selected detectors in accordance with the respective location of installation. Since each installation number issued by the central station (apart from its possible function as detector address) designates a distinct location of installation), it is of utmost importance for the operation of the system especially in case of an alarm that this assignment, even for all possible manipulations of the detector configuration, is either retained or a clearly recognizable renewed assignment is carried out.

When speaking of manipulation of the detector configuration, the following cases are referred to:

1. Replacement/Maintenance
1.1 A detector is removed from the communication line and reintroduced.
1.2 A detector is removed from the communication line and replaced by another detector.
1.3 A random number of detectors are removed from the communication line and reintroduced in a random pattern.
1.4 A random number of detectors is removed from the communication line and replaced by other detectors.
2. Extension/Reduction
2.1 A detector is removed from a randomly selected location and the loop or stub is closed again.
2.2 A detector is inserted into a randomly selected location in the loop or stub.
2.3 Several detectors are removed and inserted.
2.4 A detector is removed from a random location, the loop or stub is again closed at this location and this detector is again inserted at a random location into the loop or stub.

In case of number 1, the central station can only determine an interruption in the communication line but not whether the line interruption is caused through removal of a detector or through replacement thereof. The central station thus reruns the recognition routine of the configuration and compares its result with the recorded result of the preceding recognition routine stored in its database. The comparison yields:

In case 1.1: No change has occurred.

In case 1.2: One of the previous serial numbers is absent and a new serial number has been added. In the configuration, the new serial number occupies the location of the missing serial number.

In case 1.3: The serial numbers and the configuration are retained; however, the assignment of the serial numbers and the sequence of the detectors within the configuration have been partially modified. The central station reconstructs these modifications. Thus, the indication of messages remains based on the actual location of installation of the respective detector.

In case 1.4: The central station recognizes other serial numbers at same system configuration and thus operates like in case 1.3.

In case 2.1: The central station recognizes the absence of a serial number and a change in the configuration. The change of configuration is recognized by the absent entries of the missing detector in the S-matrix. Therefore, the central station also recognizes that the configuration has been otherwise retained. The central station thus signals a message "change of wiring".

In case 2.2 The central station determines a new serial number in the communication line and a change of the configuration, i.e. the position of insertion of a new detector. Through renewed evaluation of the S-matrix, however without the current vector of the new detector, and through comparison with the S-matrix of the preceding configuration, the central station further determines that the preceding configuration has been otherwise retained. The central station thus signals again a message "change of wiring" and requests additional information in correspondence with the location of installation of the new detector.

In case 2.3: The central station recognizes the modified serial numbers, as well as the enlargement or reduction of the S-matrix. Through evaluation of the S-matrix, the central station recognizes the original configuration insofar as being retained, and the modifications as carried out. The central station signals a message "wiring change" and, in case of addition of detectors, a request for text input regarding the location of installation of the new detectors.

In case 2.4: This modification which encompasses removal of a detector from a random location as well as the insertion of another detector in a random location can not be recognized by the central station through comparison with previous serial numbers and the preceding configuration. Therefore, the central station runs a completely new initialization.

Otherwise the central station logs changes of the system as determined in accordance with the above scheme (as well as all other relevant events). A case in which an inputted message is assigned to a location of installation of the respective detector other than the actual installation location cannot occur.

While the invention has been illustrated and described as embodied in a method for determination the configuration of detectors of a danger alarm system and for determination the system configuration of suitable detectors, it is not intended to be limited to the details shown since various modifications and structural changes may be made without departing in any way from the spirit of the present invention.

We claim:

1. A method for determining the configuration of detectors of a danger alarm system, with the detectors being in parallel connection with a central station via a two-wire communication line in form of a loop, stub or combination thereof, and with each detector including a microprocessor and a microprocessor-controlled current drain for data exchange with the central station by means of current pulses, and an address register, comprising the steps of:

designating each detector by storing a binary serial number;

installing the system and having the central station run the following steps:

a) identifying and storing in an initialization routine the serial number of each detector;

b) setting all detectors through a collective command into a discrete addressing mode and response mode for allowing each detector after being addressed by its own binary serial number to respond with a current pulse and subsequently after being addressed with the binary serial number of another detector to check the occurrence or absence of a current pulse and to store the occurrence or absence of a current pulse as binary pattern;

c) individually addressing in a first cycle each detector by its binary serial number;

d) polling in a second cycle the stored binary pattern from each detector and recording the address corresponding to the binary serial number of each detector in a column of a first square matrix having columns and lines which are numbered correspondingly with the binary serial numbers in the system;

e) adding in the first matrix each column and each line to determine respective column sums and line sums and transferring each column sum and each line sum in numbered lines of a second matrix, with the numbered lines running correspondingly with the lines of the first matrix;

f) determining a number of stubs on the basis of the column sums of the first matrix and identifying the detector arranged last in each stub;

g) identifying the detectors of the first stub on the basis of the line sums of the second matrix and determining a sequential arrangement of the detectors in the first stub;

h) identifying the detectors preceding each of the last detectors and combining them to a group of detectors;

i) determining for each group from the groups of preceding detectors, through formation of intersections, those detectors which belong only to this group;

k) upon presence of a loop, feeding in the other loop end and identifying analogous to step g) the detectors of the first stub for determining the group of detectors forming the loop;

l) upon presence of stubs, comparing the values of the column sums of the first matrix for determining the location of the branch-off points of the stubs and the sequence of the detectors thereof; and m) assigning installation numbers to the detectors in correspondence to the identified configuration and outputting the detector configuration of the system including the installation numbers.

2. The method defined in claim 1 wherein step a) includes determining the binary serial numbers of the detectors according to a method of successive approximation and sending to each detector, whose serial number has been determined and stored, a command to remain passive until all serial numbers in the system are recognized.

3. The method defined in claim 1 wherein in the discrete addressing mode and response mode according to step b), each detector sequentially records a result of the check for a present or absent current pulse of another detector, after being addressed with a binary serial number differing from its own binary serial number, in a shift register which receives a clock pulse with each new addressing.

4. The method defined in claim 1 for a danger alarm system without loop and more than one stub, wherein the central station assigns identifying numbers to the stubs in accordance with the greater number of detectors in one of the stubs.

5. The method defined in claim 1 for a danger alarm system without loop and more than one stub, wherein the central station randomly assigns identifying numbers to the stubs.

6. The method defined in claim 1 wherein the sequence of detectors in each stub is determined by the central station through arranging the values of the line sums in increasing order.

7. The method defined in claim 1 wherein the central station assigns after determining the binary serial numbers of the detector each detector an abbreviated address which is sent to the detector together with a memory command.

8. An alarm detector arrangement for use in a danger alarm system comprising:

a central station; and a plurality of detectors arranged along a two-wire communication line operatively connected to said central station, each detector including a microprocessor, a current drain controllable by said microprocessor for transmitting information commensurate with a signal transmitted from said detector to said central station, a nonvolatile memory for storing a binary serial number characteristic for each detector and an address register for storing a current vector, said current vector being represented by a distinct current impulse sequence commensurate with the number of detectors situated in the communication line following said detector as viewed from said central station;

said central station being operatively connected to each detector for determining the serial number stored in the nonvolatile memory to allow each detector to be addressed individually and for recognizing the current impulse sequence contained in the address register of each detector.

9. The detector defined in claim 8, and further comprising an ammeter means for measuring the current flow through said detector, with a current flow being generated by said current drain or a current drain of another detector, said ammeter means including an output operatively connected with the input of said microprocessor.

10. The detector defined in claim 8, and further comprising a shift register having a number of memory places at least equalling a greatest number of detectors which are operatively connectable in the communication line, said microprocessor delivering a clock pulse and sequentially recording in the shift register each detected current pulse which is generated by another detector as binary "1".

11. The detector defined in claim 9, and further comprising a second current drain controlled by said microprocessor, said ammeter means including an ammeter which is arranged between both current drains in one of the wires of the communication line looped through said detector.

12. The detector defined in claim 8, and further comprising a relay controlled by said microprocessor and including a contact over which one of the looped wires of the communication line is run, with said relay contact being bridged by two serially arranged diodes which are poled in opposite direction and have a common connecting point via which said microprocessor is fed with supply voltage.

13. The detector defined in claim 12, and further comprising a storage capacitor operatively connected to said connecting point for supplying said microprocessor after outage of the line voltage with power to allow said microprocessor to activate said relay for opening its contact.

* * * * *